US005636403A

United States Patent [19]

Grimsley et al.

[11] Patent Number: 5,636,403

[45] Date of Patent: *Jun. 10, 1997

[54] TUBE CLEANING APPARATUS

[76] Inventors: Arvid K. Grimsley, 21 Hawkwood La., Greenwich, Conn. 06830; Joseph J. Franzino, 6 Cutler Farm Rd., Trumbull, Conn. 06902; William W. Coville, 13 Treat Ave., Stamford, Conn. 06906

[ * ] Notice: The term of this patent shall not extend beyond the expiration date of Pat. No. 5,426,807.

[21] Appl. No.: 492,365

[22] Filed: Jun. 19, 1995

Related U.S. Application Data

[62] Division of Ser. No. 18,253, Feb. 16, 1993, Pat. No. 5,426,807.

[51] Int. Cl.[6] ..... B08B 9/02

[52] U.S. Cl. ..... 15/104.095; 15/104.2; 15/104.33

[58] Field of Search ..... 15/104.05, 104.09, 15/104.095, 104.096, 104.11, 104.12, 104.16, 104.2, 104.31, 104.33

[56] References Cited

U.S. PATENT DOCUMENTS

| | | | |
|---|---|---|---|
| 2,355,733 | 8/1944 | Johnson et al. | 15/104.33 |
| 2,460,149 | 1/1949 | Schoensiegel | 15/104.33 |
| 2,600,707 | 6/1952 | Turnbaugh | 15/104.33 |
| 2,769,191 | 11/1956 | Hunt et al. | 15/104.33 |
| 3,354,490 | 11/1967 | Masters et al. | 15/104.095 |
| 4,015,304 | 4/1977 | Dillinger | 15/104.095 |
| 5,235,718 | 8/1993 | Grimsley et al. | 15/104.095 |
| 5,251,356 | 10/1993 | Oaki et al. | 15/104.095 |
| 5,283,922 | 2/1994 | Ruprecht | 15/104.33 |
| 5,426,807 | 6/1995 | Grimsley et al. | 15/104.095 |

*Primary Examiner*—Mark Spisich
*Attorney, Agent, or Firm*—Patrick J. Walsh

[57] ABSTRACT

A tube cleaning apparatus for tubes and pipes installed in power plant and similar industrial equipment utilizes a rotating brush assembly fitted to one end of a rotary cable encased in a protective casing and driven at its other end in clockwise and counterclockwise rotation by a reversible motor. The invention provides a drive unit fitted with a plurality of drive rollers for engaging the protective casing and propelling the casing, cable and brush assembly at a high rate of speed into and out of each tube being cleaned. A control system for the drive unit enables the operator to manipulate the reversible motor by issuing pulses to actuate switches controlling on/off and direction of rotation of the motor. An arresting device provides for stopping forward progress of the brush assembly as it reaches the end of each tube being cleaned.

7 Claims, 8 Drawing Sheets

TUBE CLEANING APPARATUS

This application is a division of application Ser. No. 08/018,253 filed Feb. 16, 1993, now U.S. Pat. No. 5,426,807.

BACKGROUND OF THE INVENTION

The present invention relates to the cleaning of tubes and pipes of power plant equipment and machines such as boilers, chillers, condensers, heat exchangers, absorption machines and so forth.

In normal operation, the operating tubes and pipes installed in such power plant equipment and machines become coated with deposits such as soot in the case of fire tube boilers or boiler compound in the case of water tube boilers which over time reduce operating efficiency to a point that the equipment must be taken out of operation for tube cleaning. In tube cleaning, an operator uses commercially available equipment such as the Ream-A-Matic made and sold by the assignee of this invention. The Ream-A-Matic utilizes a rotating brush and water flush device which the operator inserts and hand feeds into each tube. Hand feeding of the rotating brush is assisted by rotating the brush in the direction of brush twist into the tube and reversing brush rotation for withdrawal from each tube in a manner very similar to screw rotation. Nonetheless, the cleaning operation is essentially one of hand feeding the device the full length of tubes measuring up to fifty feet in length. The cleaning operation is time consuming even as the the device performs a thorough cleaning of each tube.

When this kind of cleaning is performed the entire plant must be shut down and, often, a full maintenance schedule is carried out for a piece of equipment or for the entire plant. Because of the economic loss sustained during plant shutdown it is imperative that the maintenance schedule be completed as quickly as possible. For example, in a typical electrical utility, hourly loss of power generation revenue is approximately $50,000 during plant shutdown so there is considerable incentive for rapid as well as thorough performance of the maintenance schedule.

The present invention provides an apparatus for substantially reducing the time required for cleaning power plant tubes and pipes without compromising the thoroughness of the cleaning operation.

SUMMARY OF THE INVENTION

The present invention comprises a tube and pipe cleaning apparatus in which an elongated, generally cylindrical brush is propelled into and withdrawn from a pipe or tube for cleaning the tube interior. A water flush component following behind the brush flushes removed deposits out the other end of the tube. The brush is fitted to the leading end of a flexible rotatable shaft which is encased in a flexible sleeve or casing which does not rotate and is normally engaged by a drive mechanism which advances and withdraws the brush from each tube. A reversible motor advances and retracts the flexible casing and brush assembly, and if desired, rotates the shaft and brush clockwise while advancing into the tube and counterclockwise while withdrawing from the tube.

According to the invention, the flexible casing containing the rotatable drive shaft is routed through a drive mechanism which propels the casing longitudinally into a tube at a high rate of speed as the brush and water-flush clean the tube. On command of the operator, the drive mechanism reverses direction thereby rapidly withdrawing the brush assembly from the tube. The operator repeats this basic operation for each tube to be cleaned. Preferably, the interior flexible shaft and brush assembly are rotated and counterrotated while the casing and brush assembly are advanced and retracted, respectively, from each tube.

The drive mechanism for the flexible casing and brush assembly is provided with a plurality of drive rollers arranged on opposite sides of a line of travel of the flexible casing through the drive mechanism. Preferably, the drive rollers encroach the line of travel slightly to provide positive driving engagement between the rollers and flexible casing. Roller encroachment results in a characteristic sinusoidal or snake-like path of the flexible casing through the drive rollers.

Each of the rollers is mounted on a shaft and driven by a gear train comprising spur gears fitted to each shaft. The gear train and rollers are driven by means of a propeller shaft connected to a reversible drive motor by means of a belt drive. By controlling direction of rotation of the drive motor the operator propels the brush assembly into and out of each tube.

The invention includes a control system enabling the operator to reverse direction of movement of the flexible casing and brush assembly into and out of each tube. The control system includes an operating handle having the general appearance of a pistol including a pistol grip, a control trigger, and a barrel which provides a passageway for the flexible casing and brush assembly as they are positioned adjacent each tube during a cleaning operation. In a preferred embodiment of the invention, the operating handle is provided with a pneumatic link to the reversible motor, to a flexible casing arresting device forming part of the casing drive mechanism, and to a source of pressurized air. By squeezing the trigger in one direction (clockwise, for example) the operator sends an air pulse or pneumatic signal to a forward air switch controlling the reversible drive motor thereby to operate the drive mechanism and advance the flexible casing and brush assembly into a tube. To withdraw the flexible casing and brush assembly from a tube, the operator squeezes the trigger in the opposite (counterclockwise) direction sending another air pulse to a reverse air switch for the reversible motor thereby reversing motor and drive mechanism rotation and withdrawing the flexible casing and brush assembly.

In a preferred embodiment of the invention, the control air system includes a source of pressurized air and air lines interconnecting the operating handle, the forward and reverse air switches for the motor, and a device for arresting movement of the flexible casing and brush assembly. The operating principle of the control air system is that each air switch operates the drive motor (i.e., turns "on") with buildup of air pressure in its air line and turns "off" when the air line is vented. Accordingly, the operating handle is connected by separate (i.e., forward and reverse) air lines to the motor forward and reverse air switches. By moving the trigger to the forward position, the air lines to the forward air switch are pressurized and the motor operates to advance the brush into a tube. At the same time the trigger vents the reverse air line and the reverse air switch remains in the "off" position. In like manner, by reversing the trigger, the forward air line is vented and the forward air switch goes to its "off" position while the reverse air line is pressurized and the motor reverse air switch goes on. The operating trigger includes a normal, neutral position wherein both the forward and reverse air lines are vented so that both of the motor control air switches are in the off position.

As noted, industrial tubes of up to fifty feet in length are cleaned by the device of the present invention. Because of tube length as well as the linear speed of the cleaning device into and out of each tube it is necessary to provide for braking of the flexible casing so that the flexible casing is stopped when the brush assembly reaches the far end of a tube and that the casing is again stopped when the brush clears the near end of the tube on withdrawal.

Accordingly, the invention further includes a flexible casing arresting device which limits the extent of forward movement of the casing to the approximate length of tube being cleaned. The arresting device includes a collar mounted on the casing for actuating an air vent forming part of the forward air line control. The collar is positioned on the casing so that when the casing advances the desired length into a tube, the collar opens a vent in the forward control air line thereby deactivating the forward motor control air switch, stopping the motor, and arresting movement of the casing. To withdraw the casing from a tube, the operator moves the control trigger to the reverse position for activating the reverse air switch to reverse the motor.

The present invention can be installed in conventional tube cleaning equipment such as Assignee's Ream-A-Matic equipment as a user installed improvement kit or as an integrated factory product. Both embodiments are described below.

OBJECTS OF THE INVENTION

An object of the invention is to provide a tube cleaning apparatus which significantly reduces the time required for cleaning tubes installed in power plant equipment.

Another object of the invention is to provide a tube and pipe cleaning apparatus for power feed of a cleaning device into and out of tubes.

Another object of the invention is to provide a control mechanism enabling an operator to conveniently and quickly control projection and withdrawal of a cleaning device into and out of tubes.

Another object of the invention is to provide a braking mechanism for stopping linear movement of the cleaning device as it clears the far end of a workpiece tube.

A further object of the invention is to provide a control system for a tube cleaning apparatus which is safe to use and reliable in operation.

A further object of the invention is to provide a control system which uses air as an operating medium together with an operating principle equating control air pressure with one operating mode and control air venting with another operating mode.

Another object of the invention is to provide control principles for a tube cleaning apparatus that are safe and reliable, that are preferably embodied in an pneumatic control system and are applicable also to analogous electric, radio and mechanical systems.

Another object of the invention is to provide a robust, lightweight, safe and easy to operate control handle enabling an operator to position, advance, and retract the cleaning device for each tube.

Other and further objects of the invention will become apparent with an understanding of the following detailed description of the preferred embodiment of the invention or upon employment of the invention in practice.

DESCRIPTION OF THE DRAWING

A preferred embodiment of the invention has been chosen for purposes of illustrating the operative principles of the invention and is shown in the accompanying drawing in which.

DETAILED DESCRIPTION OF THE PREFERRED EMBODIMENT

Figure 2:
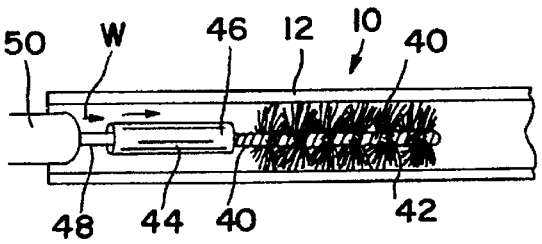
FIG. 2 is a schematic view partly in section of a cleaning brush assembly used with the invention and shown in cleaning position within a tube or pipe.
Figure 1:
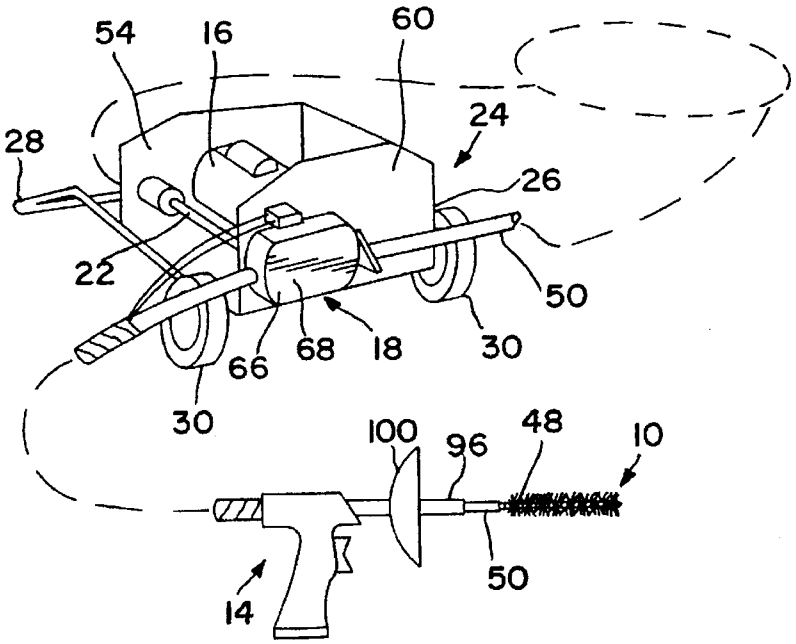
FIG. 1 is a perspective view of a tube cleaning apparatus according to the invention including power console, flexible casing and brush assembly, and operator's control handle.

Referring to FIGS. 1 and 2 of the drawing, the present invention is primarily concerned with rapidly driving a cleaning brush 10 down and back the full length of a tube 12 forming part of industrial equipment such as a condenser, heat exchanger and the like. A preferred embodiment of the cleaning apparatus includes a control handle 14 normally held and used by the tube cleaning operator for advancing and withdrawing the brush from a tube, a reversible drive motor 16 providing rotary drive to a drive unit 18 via a drive belt 20 and propeller shaft 22 all mounted on a power console 24. The power console is in the form of a hand truck fitted with a chassis 26 containing the various operating components, a handle 28 and wheels 30. A top cover (not shown) for the chassis has been removed to illustrate interior operating components.

As shown in FIG. 2, the tube and pipe cleaning apparatus includes an elongated, generally cylindrical brush propelled into and withdrawn from a pipe or tube for cleaning the tube interior. The brush 10 is of suitable design as for example having a twisted wire spine 40 securing bristles 42 in a well known manner. A brush of this kind is particularly suited for rotary cleaning of a tube because the bristles are wound in a twist or spiral having a natural tendency to move along the tube in the direction of twist in the manner of a screw thread. Accordingly, the brush moves down into the tube with clockwise rotation of the brush and is withdrawn with opposite rotation. The brush assembly further includes a mounting collar 44 having an internally threaded tip 46 for receiving the near end of the brush spine. A water flush component W following behind the brush flushes removed deposits out the other end of the tube. The chassis is provided with a water connection W for this purpose.

The brush is fitted to the leading end of a flexible rotatable shaft 48 which is encased in a flexible sleeve or casing 50. The flexible drive shaft is of suitable manufacture such as wound steel cable employed for speedometer cables in automotive applications. The flexible casing containing the rotatable drive shaft is routed through the drive unit 18 which propels the casing longitudinally into a tube at a high rate of speed as the brush and water-flush clean the tube. On command of the operator, the drive unit reverses direction thereby rapidly withdrawing the brush assembly from the tube. The operator repeats this basic operation for each tube to be cleaned.

Preferably, the interior flexible shaft 48 and brush assembly 10 are rotated and counterrotated while the casing and brush assembly are advanced and retracted, respectively, from each tube. For this purpose, the trailing end 52 of the flexible casing and drive shaft are connected to the propeller shaft 22 through the rear wall 54 of the chassis. In this way both the advancement and retraction as well as the rotation and counterrotation of the brush assembly are determined by direction of propeller shaft rotation.

The reversible motor 16 drives the propeller shaft through a belt 56 and pulley 58 transmission. As noted, the propeller shaft projects through the rear wall of the chassis and is there connected to the rotatable flexible shaft by a suitable coupling (not shown). The propeller shaft also extends through the front wall 60 of the chassis for connection to a drive pinion 61 located in the drive unit by a split shaft 62 as best shown in FIGS. 4 and 5.

Figure 4:
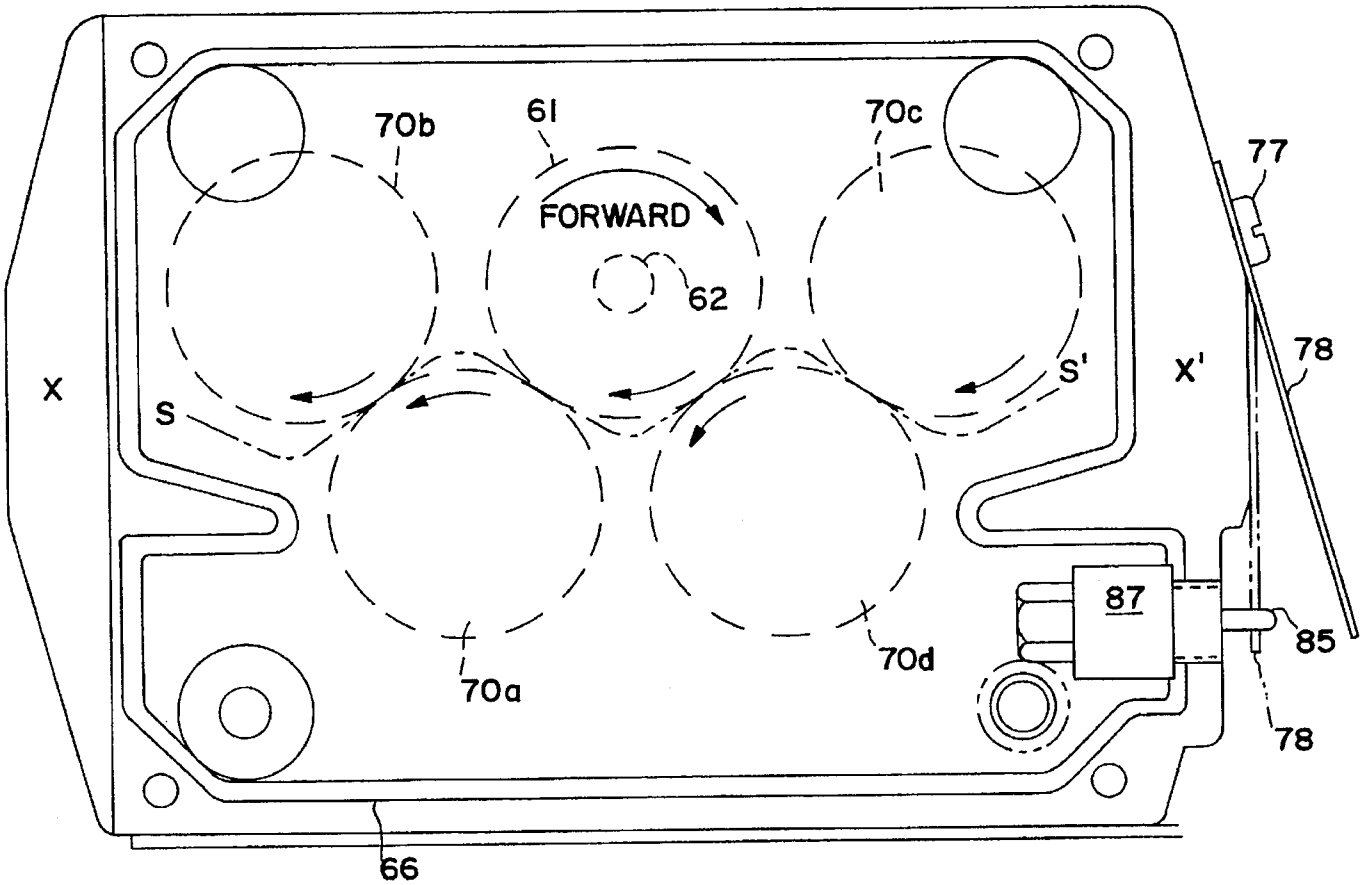
FIG. 4 is an enlarged front view of the drive unit with its front cover removed to illustrate the line of travel through the drive head, the arrangement of drive rollers for the flexible casing, and a brake mechanism for the flexible casing.
Figure 5:
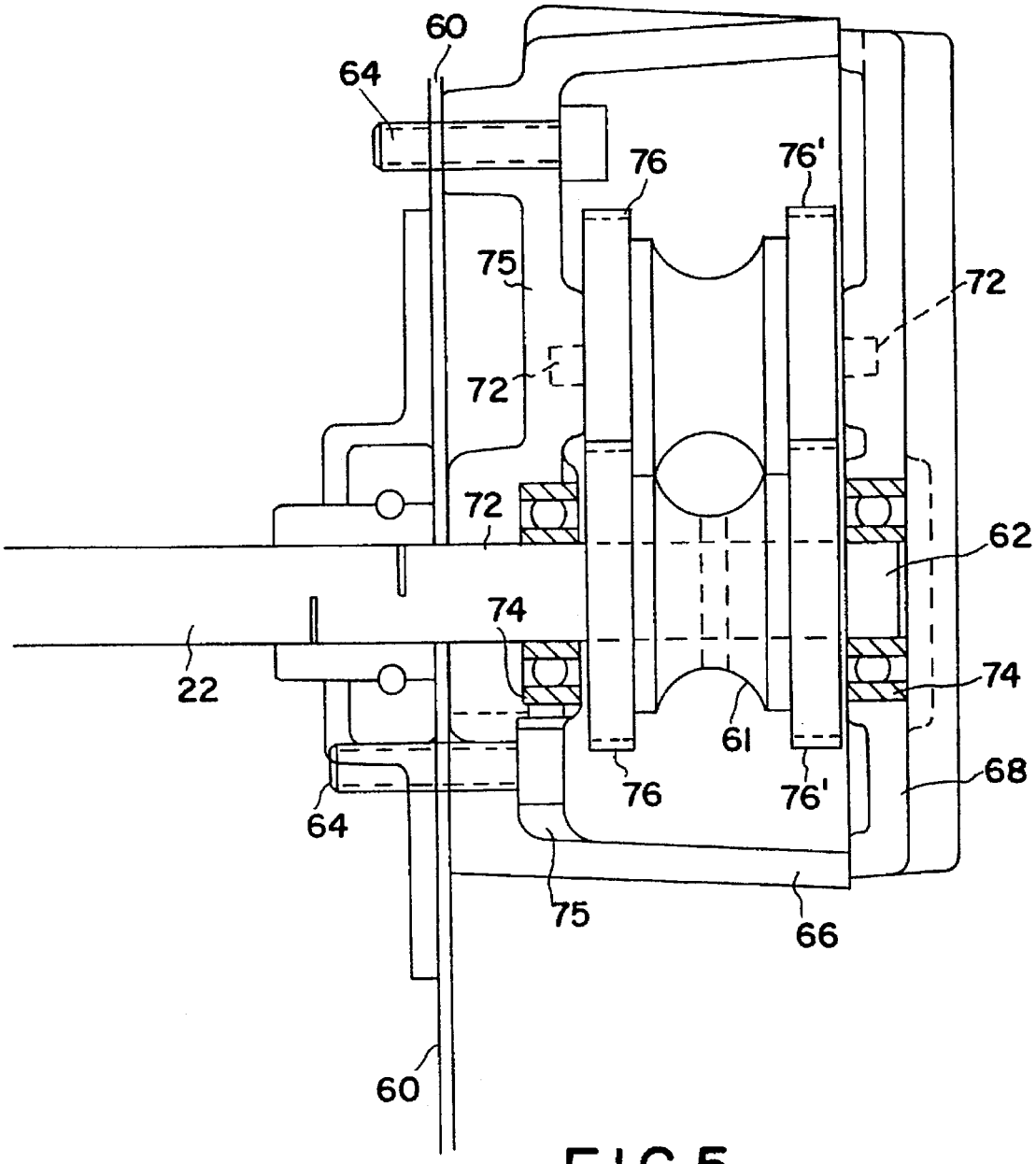
FIG. 5 is an side view of of the drive unit of FIG. 4 showing a preferred arrangement for mounting drive rollers.

In accordance with the invention, the drive unit illustrated in FIGS. 4–5 is mounted with suitable fasteners 64 on the front wall 60 of the chassis and includes a roller casing 66 having a removable cover 68. A plurality of concave rollers 70*a*–70*d* are positioned on either side of a line of travel x–x' for driving the flexible casing into or out of a tube according to the direction of roller rotation. In order to provide positive driving engagement of the flexible casing, the rollers are nested and encroach the line of travel so the flexible casing takes on a sinuous form as it negotiates the roller section during operation. As shown in FIG. 4, roller 70*a*, for example, is nested between and forms nips with roller 70*b* and drive pinion 61 for driving the flexible casing through a sinuous line of travel s–s'. A sinuous line of travel substantially reduces the risk of loss of traction resulting from casing wear caused by the driving rollers. With a straight line of travel, a slight amount of casing wear, say 0.005 inch, is likely to result in loss of traction because the rollers have insufficient "bite" on the casing surface. On the other hand, with a sinuous line of travel, the casing surface is displaced an aggregate of 0.020 inch above and below a straight line of travel so that traction is not lost unless casing wear is substantial and exceeds the displacement distance.

The rollers 70*a*–70*d* are fitted to and freely rotate about support shafts 72 positioned between bearings carried by removable cover 68 and rear casing wall 75. The drive pinion 61 and each roller 70*a*–70*d* has a pair of gears 76 and 76' forming part of a gear train for rotating the rollers as they cooperate in advancing or withdrawing the brush assembly from each tube. The rollers 61 and 70*a*–70*d* are shown in FIG. 4 with roller drive proceeding as shown by arrows so that the rollers on either side of the line of travel x–x' rotate in the same direction when driving the flexible casing.

Figure 3:
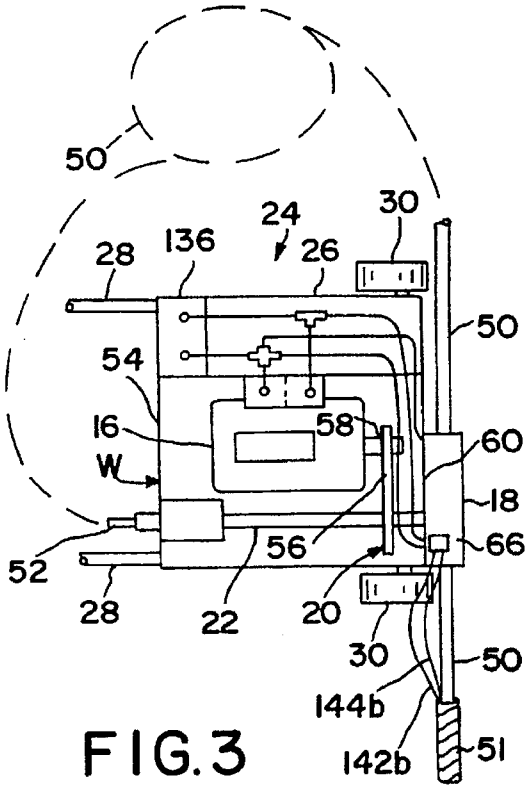
FIG. 3 is a plan view of the power console illustrating air supply pump, drive motor, propeller shaft, and drive unit of the tube cleaning apparatus.

As shown in FIGS. 3, 4 and 5, the drive roller 61 and the rollers 70*a*–70*d* are driven by means of the propeller shaft 22 which is powered by the reversible drive motor. A drive unit according to the invention may accommodate flexible casings in a variety of diameters as required for different cleaning operations. Rollers shown in FIGS. 4 and 5 accommodate larger size casings. Other rollers with smaller concavity for a smaller diameter flexible casing may also be used. A tube cleaning apparatus includes several sets of rollers as accessories to be selected and installed in the drive head by the operator according to the flexible casing diameter required for a particular work piece tube diameter. A set of rollers is installed by removing the pulley cover and mounting the rollers on drive shafts.

Figure 6:
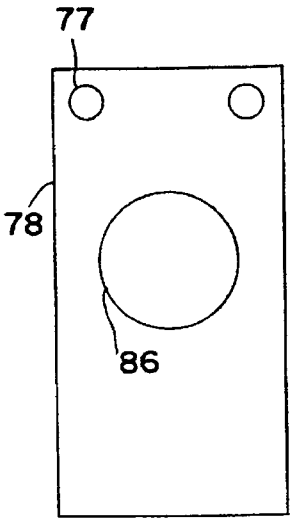
FIG. 6 is a front elevational view of a spring forming part of a brake mechanism for the flexible casing.
Figure 8A:
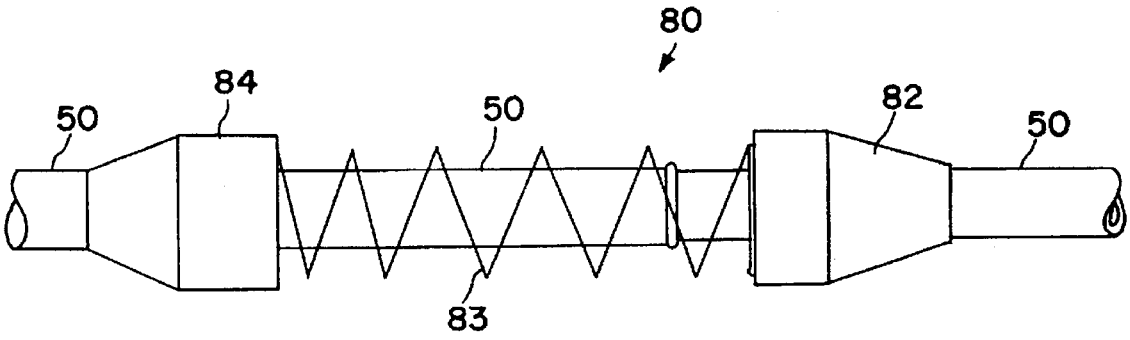
FIGS. 8*a* and 8*b* are sequential schematic views of a flexible casing stop assembly.
Figure 8B:
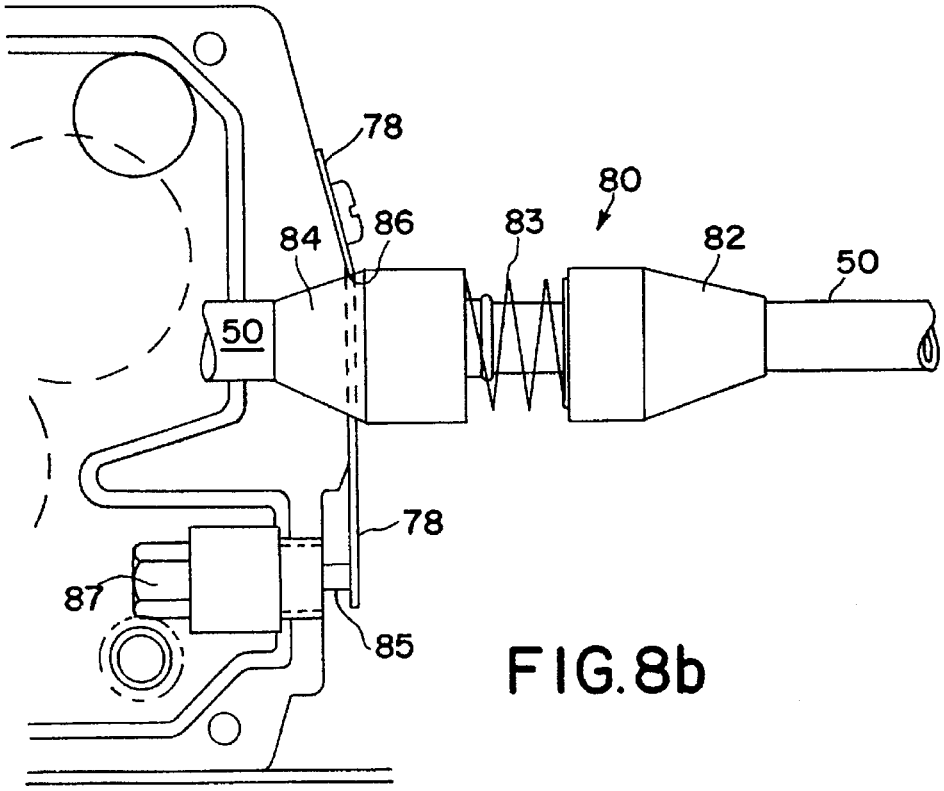
Figure 9:
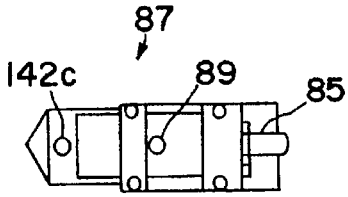
FIG. 9 is a rear view of a vent valve forming part of the flexible casing stop assembly.

As best shown in FIGS. 4 and 6, the inner face of the drive unit is fitted at 77 with a leaf spring which forms part of an arresting mechanism 80 (FIGS. 8*a* and 8*b*) for stopping forward progress of the flexible casing after travelling a predetermined distance into a workpiece tube being cleaned. Ordinarily the predetermined distance is the length of tube plus an allowance of casing length to accommodate freedom of movement of operator and equipment at the entrance to each tube. The predetermined distance is selected as the location on the flexible casing for the arresting assembly shown in FIGS. 8*a* and 8*b*. The arresting assembly comprises a locking collar 82 clamped to the flexible casing, a stop cone 84 slidably mounted on the flexible casing, and a coil spring 83 fitted about the casing for normally maintaining the spacing of collar and cone shown in FIG. 8*a*. The ends of the coils spring are attached to the locking collar and stop cone to maintain assembly of the arresting device as in FIG. 8*a*. When operating, the flexible cable enters the drive unit pulley casing through an opening 86 in the leaf spring with the spring maintaining the cocked position shown in FIG. 4. As the flexible casing 50 moves forward through the drive unit 18, the stop assembly 80 advances toward the leaf spring and eventually the stop cone enters the leaf spring opening moving the leaf spring forward to the dash line position of FIG. 4 where the lower edge of the spring engages a vent button 85 for opening a vent valve 87. The vent valve is part of the pneumatic control system and stops the drive motor and flexible casing movement as described more fully below in connection with the description of the pneumatic control system. The vent valve 87 is provided with control air through air link 142*c* (FIG. 10) which closes the valve. When the button 85 is depressed by the arresting gear leaf spring 78, the valve opens and control air vents through outlet port 89.

The coil spring 83 normally separating the cone and collar serves the dual functions of absorbing the force of the stop cone engaging the leaf spring and pulley casing and of allowing continued forward movement of the flexible casing through the driving pulleys as the pulleys come to rest when the motor stops. The latter function avoids undue wear of the flexible casing forward of the stop cone which would otherwise result if moving pulleys repeatedly engaged the same surface area of the stationary casing during each operation of the arresting gear.

Figure 7:
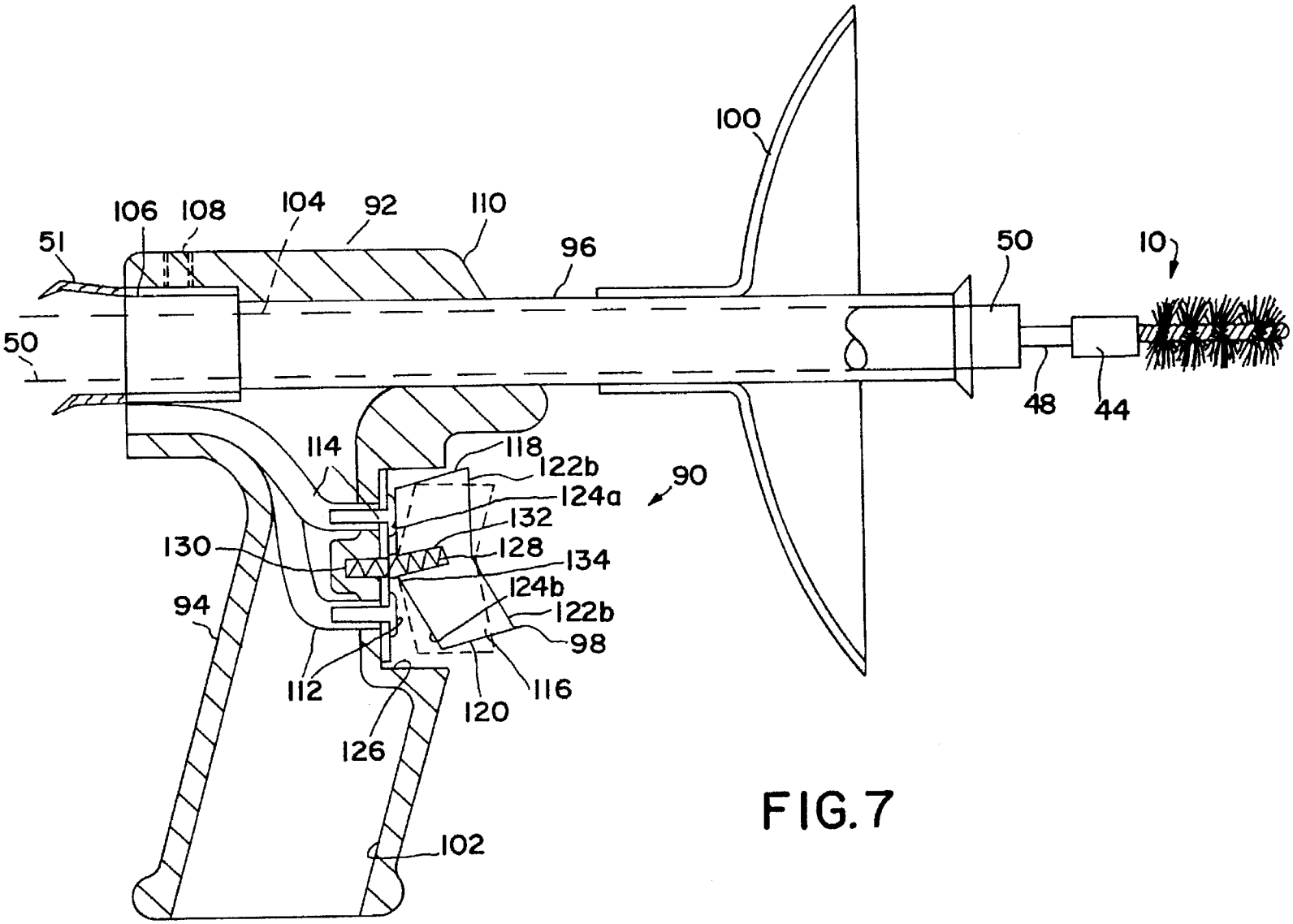
FIG. 7 is a side elevational view partly in section of a preferred control handle for positioning, advancing, and retracting the flexible casing and brush assembly with respect to each tube.

The operator's control handle 90 is illustrated in FIG. 7 of the drawing and is of pistol-like construction including frame 92 with integral depending grip 94, a barrel 96, a trigger 98 and a splash guard 100. The frame and grip are fabricated of lightweight durable material such as aluminum or high density plastic with the grip having a hollow interior 102 and the frame having a through passageway 104 for mounting the barrel. The rear face of the frame includes an enlarged bore 106 and fastener 108 for securing an outer protective sheath 51 to the control handle. The barrel is a hollow tube secured to the frame and projects from the front face 110 of the frame a suitable distance. A splash guard 100 may be fitted to the the barrel to protect the operator from back splash of the water flush by the brush assembly when it is withdrawn from a tube during cleaning operations.

The operational controls forming part of the control handle include a trigger 98 cooperating with vent forward 112 and reverse 114 tubes forming part of the preferred pneumatic control system. The trigger comprises a block of plastic of other suitable lightweight material with dihedral side faces 116 and flat top 118, bottom 120, front 122*a–b* and rear 124*a–b* panels. The trigger fits into a recess 126 in the front of the grip and is secured to the grip by a rocker spring 128. The rocker spring is tightly fitted to openings 130, 132 in the grip and the trigger. The spring enters the trigger at the apex 134 of the dihedral and normally maintains the trigger in a neutral position shown in dash lines in FIGS. 7 and 10 with rear faces 124*a–b* spaced from the control system vent openings 112, 114. The function of the trigger is normally to vent both openings and to close one or the other of the vent openings for activating the pneumatic control system and moving the flexible casing and brush assembly.

Figure 10:
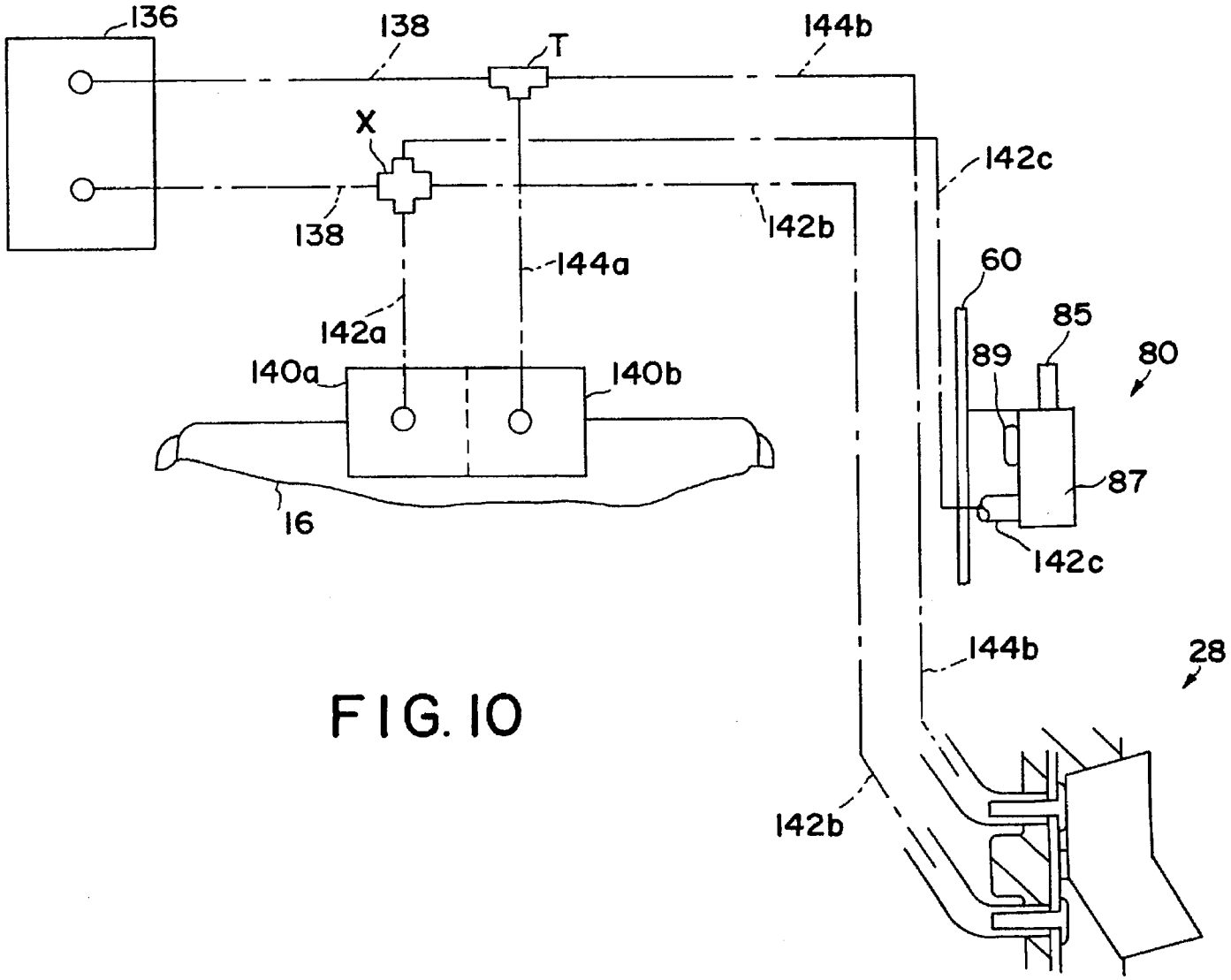
FIG. 10 is a schematic view of a preferred pneumatic control system for the tube cleaning apparatus.

The pneumatic control system is shown in FIG. 10 and includes an air supply 136 connected by flexible tubing 138 to the air switches 140*a–b* for the reversible motor 16, to the control handle 28 and to the flexible cable arresting device 80 forming part of the drive unit 18. Forward control includes pneumatic links 142*a* from the air source to the forward air switch 140*a* through an X connection from which vent links 142*b* and 142*c* extend to the control handle 28 and to the arresting device 80. Reverse control includes pneumatic links 144*a* from the air source to the reverse air switch 140*b* through a T connection from which a vent link 144*b* extends to the control handle. The air source 136 is provided by a suitable pump or compressor such as an aquarium pump made by Electro-Mechanical Mfg. Co of Copely Ohio model P or V 2000 Series. The pneumatic links are formed of flexible tubing 138 for connection to the several points of the control system.

In operation, the air source operates continuously and supplies control air through the flexible tubing to the various operating points of the control system. The normal position of the control trigger is to vent both the forward and reverse control links so that the operating components of the tube cleaning apparatus are at rest and the reversible drive motor is "off". To begin operation for cleaning a tube, the operator moves the trigger to the forward position thereby closing the forward vent and pressurizing the forward air link and actuating the forward air switch and operating the drive motor. The drive unit propels the flexible casing and brush assembly into a tube for cleaning the tube interior. Propulsion of the brush assembly continues until the arresting gear fitted to the flexible casing encounters and opens the arresting vent as described above. By opening the arresting vent, control air pressure in the forward pneumatic link falls and the forward air switch opens thereby securing the reversible drive motor. The arresting condition occurs when the brush assembly has reached the far end of a workpiece tube and must be withdrawn. At this point, the only control option available to the operator is to reverse the drive unit and withdraw the brush assembly. This is done by reversing the trigger position to cover the reverse vent on the control handle, pressurize the reverse control link, and actuate the reverse air switch to reverse the motor and withdraw the brush assembly from the tube. Reverse movement of the brush assembly continues until the brush clears the near end of the tube. The rearward movement of the brush assembly may be arrested by a mechanical device fitted to the control barrel and described in copending application Ser. No. 782,085 filed Oct. 24, 1991, now U.S. Pat. No. 5,235,718. As an alternate, the operator may release the trigger to open reverse vent when the brush assembly emerges from the tube thereby shutting down the drive motor.

Figure 11:
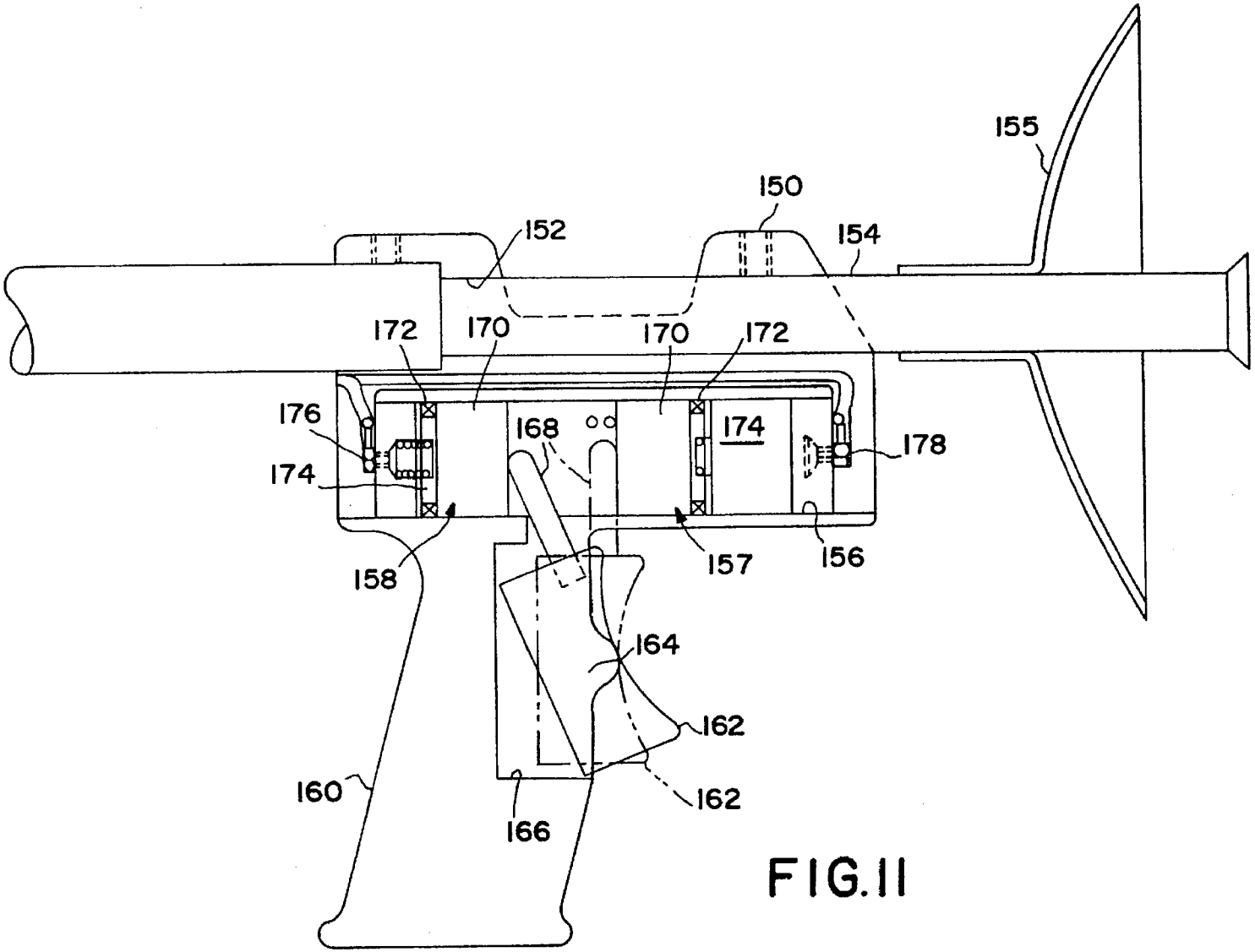
FIG. 11 is a side elevational view partly in section of a modified embodiment of the control handle showing air pulse generators.

FIG. 11 illustrates a modification to the control handle and pneumatic control system. The control handle includes a frame 150 with longitudinal passage 152 accommodating a barrel 154 and splash guard 155, and with a cylinder chamber 156 accommodating forward 157 and reverse 158 air pulse generators or bellows. A grip 160 depends from the frame and includes a trigger 162 fitted to a pivot pin 164 within a recess 166 at the front face of the trigger. An upright arm 168 projects from the trigger into the bellows chamber. Each pulse generator includes a piston 170, a seal ring 172, a spring loaded bellows 174 and outlet ports 176, 178 with flexible tubing connected to the air control system. In this embodiment of the invention, the pulse generators perform the function of the air supply 136 of FIG. 10 which is eliminated from this modification. Accordingly, the pulse generators activate the forward and reverse motor control air switches by rotating the trigger clockwise for forward movement of the brush assembly and conterclockwise for reversing the brush. When the upright arm (and trigger) is in central position the pulses are released and the air switches go to "off" position. Additionally, an arresting mechanism of FIGS. 8*a* and 8*b* may be used with this embodiment of the invention in which case the motor stops when the forward pulse is vented.

Figure 12:
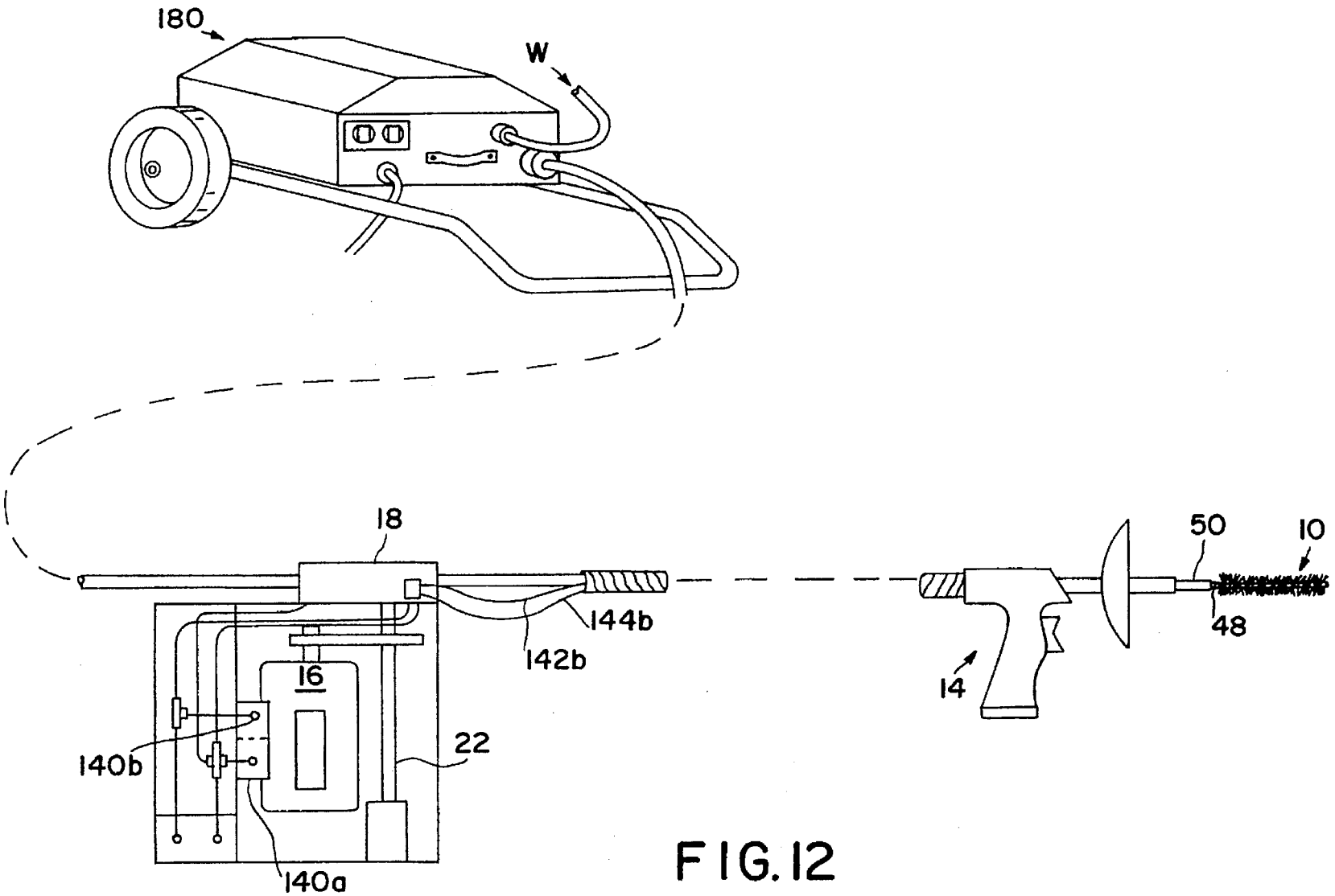
FIG. 12 is a schematic view of a modification of the invention for applying the tube cleaning apparatus to pre-existing tube cleaning machines.

In a modification to the general arrangement of the invention, the tube cleaning apparatus may be fabricated for use with a preexistingtube cleaning machine 180 shown in FIG. 12. In this arrangement, a reversible drive motor 16 operates drive unit 18 through the propeller shaft 22 for driving the casing 50 while machine 180 provides for rotation of the flexible shaft 48 within the casing. Flushing water is provided through the flexible casing in the usual manner via inlet W. The control handle 14 enables the operator to actuate the drive unit and brush assembly rotation in coordinated manner by means of air tubes 142*b*, 144*b* and air switches 140*a*, 140*b* as described.

It is within the scope of the invention to utilize other control systems for the the cleaning apparatus. For example, the pneumatic air pulses or signals issued from the control handle through air links to the air switches are illustrative embodiments and other specific, analogous means such as electric, mechanical or radio pulses or signals can be used through appropriate links to turn the drive motor "on" and "off" and to form part of the arresting gear described.

We claim:

1. A tube cleaning apparatus comprising a portable housing, a reversible drive motor mounted within the housing, an elongated cable having a brash assembly affixed thereto for cleaning the interior surfaces of tubes, a protective casing covering the cable, means affixed to the housing powered by said drive motor for engaging the cable intermediate its ends and for propelling the cable and brush assembly into and out of tubes for cleaning the interior surfaces of the tubes, and a portable control handle having a passageway for positioning the cable and brush assembly at each tube to be cleaned, and the control handle having means for signalling the propelling means to propel the cable and brush assembly into and out of tubes and to stop movement of the cable and brush assembly.

2. A tube cleaning apparatus as defined in claim 1 in which the control handle issues pneumatic signals to control the cable and brash assembly.

3. A tube cleaning apparatus comprising an elongated cable having a brush assembly affixed thereto for cleaning the interior surfaces of tubes, a protective casing covering the cable, a power console, a reversible drive motor mounted within the power console, air switch means for operating the motor in forward and reverse modes, means affixed to the power console driven by the drive motor for engaging the cable intermediate its ends and for propelling the cable and brush assembly into and out of tubes for cleaning the interior surfaces of the tubes, and a portable control handle having a passageway for positioning the cable and brush assembly at each tube to be cleaned, and the control handle having means for signalling the air switch means to propel the cable and brush assembly into and out of tubes and to stop movement of the cable and brush assembly.

4. A tube cleaning apparatus as defined in claim 3 in which the control handle includes means for generating air pulses.

5. A tube cleaning apparatus as defined in claim 4 in which the means for generating air pulses comprises forward and reverse air bellows fitted into the control handle, and in which the control handle includes a trigger for selectively actuating the means for generating air pulses for moving the brush assembly.

6. A tube cleaning apparatus as defined in claim 3 which further includes an arresting device for stopping forward progress of the cable and brush assembly.

7. A tube cleaning apparatus comprising a portable housing, an elongated cable having a brush assembly affixed thereto for cleaning the interior surfaces of tubes, a protective casing covering the cable, a reversible drive motor within the portable housing, air switch means for operating the motor in forward and reverse modes, means affixed to the housing driven by the drive motor for engaging the cable intermediate its ends and for propelling the cable and brush assembly into and out of tubes for cleaning the interior surfaces of the tubes, an air supply providing control air, air links connecting the air supply to the air switch means, a portable control handle having a passageway for positioning the cable and brush assembly at each tube to be cleaned, and air links to the control handle for signalling the air switch means to propel the cable and brush assembly into and out of tubes and to stop movement of the cable and brush assembly.

* * * * *